US008251233B1

(12) United States Patent
Biglow

(10) Patent No.: US 8,251,233 B1
(45) Date of Patent: Aug. 28, 2012

(54) SHELVING SYSTEMS

(75) Inventor: Charlotte Biglow, Indio, CA (US)

(73) Assignee: CLB Enterprises, Inc. II, Indio, CA (US)

( * ) Notice: Subject to any disclaimer, the term of this patent is extended or adjusted under 35 U.S.C. 154(b) by 0 days.

(21) Appl. No.: 12/958,156

(22) Filed: Dec. 1, 2010

Related U.S. Application Data

(60) Provisional application No. 61/283,310, filed on Dec. 1, 2009.

(51) Int. Cl.
*A47F 1/04* (2006.01)

(52) U.S. Cl. ..... 211/59.2; 211/187

(58) Field of Classification Search ..... 211/59.2, 211/59.3, 190, 207, 103, 75, 74, 187, 189, 211/184; 108/24, 61, 109, 107, 60; 312/35, 312/72

See application file for complete search history.

(56) References Cited

U.S. PATENT DOCUMENTS

| | | | | | |
|---|---|---|---|---|---|
| 1,758,098 | A | * | 5/1930 | Williams | 211/74 |
| 2,915,193 | A | | 12/1959 | Bromberg | |
| 4,383,614 | A | | 5/1983 | Miller | |
| 4,416,380 | A | * | 11/1983 | Flum | 211/59.2 |
| 4,454,949 | A | * | 6/1984 | Flum | 211/59.2 |
| 4,565,725 | A | | 1/1986 | Spamer et al. | |
| 4,765,493 | A | * | 8/1988 | Kinney | 211/59.2 |
| 4,809,855 | A | * | 3/1989 | Bustos | 211/59.2 |
| 4,909,402 | A | | 3/1990 | Highsmith | |
| 4,960,210 | A | * | 10/1990 | Spamer | 211/59.2 |
| 5,022,535 | A | | 6/1991 | Spamer | |
| 5,094,350 | A | * | 3/1992 | Smock | 211/59.2 |
| D370,367 | S | | 6/1996 | Cassier et al. | |
| D375,860 | S | | 11/1996 | Coretti, Jr. et al. | |
| 5,607,068 | A | | 3/1997 | Coretti, Jr. et al. | |
| 5,695,076 | A | * | 12/1997 | Jay | 211/59.2 |
| 5,806,689 | A | * | 9/1998 | Mays et al. | 211/59.2 |
| 5,868,262 | A | * | 2/1999 | Carson | 211/59.2 |
| 5,992,651 | A | | 11/1999 | Shaw et al. | |
| 6,047,647 | A | * | 4/2000 | Laraia, Jr. | 108/61 |
| 6,132,158 | A | * | 10/2000 | Pfeiffer et al. | 414/276 |
| 6,168,032 | B1 | * | 1/2001 | Merl | 211/59.2 |
| 6,328,170 | B1 | * | 12/2001 | Lee | 211/59.2 |
| 6,332,547 | B1 | * | 12/2001 | Shaw et al. | 211/59.2 |
| 6,523,664 | B2 | | 2/2003 | Shaw et al. | |
| 6,729,484 | B2 | | 5/2004 | Sparkowski | |

(Continued)

FOREIGN PATENT DOCUMENTS

DE 19609432 9/1997

*Primary Examiner* — Darnell Jayne
*Assistant Examiner* — Patrick Hawn
(74) *Attorney, Agent, or Firm* — Kolisch Hartwell, PC

(57) ABSTRACT

A shelving system and a shelf for that system are disclosed. The shelving system may include a frame base; upright frame bars connected to the frame base, the upright frame bars including a plurality of apertures; and a plurality of shelves. One or more of the plurality of shelves may include front, left, right, and rear walls, the left and right walls including at least one connector configured to be received in one or more apertures of the plurality of apertures; at least one base member connecting the front and rear walls; and at least one glide sheet configured to allow gravity to move the items supported on the at least one glide sheet toward the front wall, the shelf being free from a locking mechanism that secures the at least one glide sheet to one or more other components of the shelf.

20 Claims, 8 Drawing Sheets

U.S. PATENT DOCUMENTS

| | | | | |
|---|---|---|---|---|
| 6,883,671 | B2 | 4/2005 | Rushing | |
| 7,114,606 | B2 | 10/2006 | Shaw et al. | |
| 7,124,897 | B2 * | 10/2006 | Bustos | 211/59.3 |
| 7,200,903 | B2 | 4/2007 | Shaw et al. | |
| D545,092 | S | 6/2007 | Knorring, Jr. et al. | |
| D565,324 | S | 4/2008 | Sparkowski | |
| D573,369 | S | 7/2008 | Sparkowski | |
| D580,193 | S | 11/2008 | Sparkowski | |
| D591,531 | S | 5/2009 | Sparkowski | |
| 7,644,827 | B2 | 1/2010 | Hanretty | |
| D611,743 | S | 3/2010 | Mitten et al. | |
| 7,681,743 | B2 | 3/2010 | Hanretty et al. | |
| 7,806,282 | B1 | 10/2010 | LaBonia, Jr. et al. | |
| 2002/0060198 | A1 * | 5/2002 | Bustos | 211/187 |
| 2002/0104466 | A1 | 8/2002 | Carson et al. | |
| 2003/0084827 | A1 | 5/2003 | Nicholson et al. | |
| 2004/0020878 | A1 * | 2/2004 | Boron | 211/59.2 |
| 2004/0178156 | A1 | 9/2004 | Knorring, Jr. et al. | |
| 2005/0258113 | A1 * | 11/2005 | Close et al. | 211/59.3 |
| 2006/0032827 | A1 * | 2/2006 | Phoy | 211/59.2 |
| 2006/0113263 | A1 | 6/2006 | Kratochvil | |
| 2006/0283819 | A1 * | 12/2006 | Larsen et al. | 211/59.2 |
| 2008/0016740 | A1 | 1/2008 | Mitten et al. | |

* cited by examiner

SHELVING SYSTEMS

CROSS-REFERENCE TO RELATED PATENT APPLICATIONS

This application claims priority under 35 U.S.C. §119(e) to U.S. Provisional Patent Application Ser. No. 61/283,310 entitled "Shelving Systems," filed Dec. 1, 2009. The complete disclosure of the above application is herein incorporated by reference for all purposes.

BACKGROUND OF THE DISCLOSURE

Shelving systems are used to display and/or store a variety of items. For example, shelving systems may be used in refrigerated display cases in supermarkets, convenience stores, restaurants, etc. An example of a type of shelving system is the gravity-feed or gravity-flow shelving system that allows gravity to move items toward the front of the shelf. The gravity-feed shelving system includes shelving or shelves that are inclined or slanted. Additionally, the shelving includes a base supporting the items that includes either a glide/slide sheet or a plurality of rollers that allows the items to move toward the front of the shelf.

Example of shelves and shelving systems, including gravity-feed or gravity-flow shelving systems, are described in U.S. Pat. Nos. 2,915,193; 4,383,614; 4,909,402; 5,022,535; 5,607,068; 5,992,651; 6,047,647; 6,332,547; 6,523,664; 6,729,484; 6,883,671; 7,114,606; 7,200,903; 7,644,827; 7,681,743; 7,806,282; D375,860; D545,092; D565,324; D573,369; D580,193; D591,531; and D611,743; U.S. Patent Application Publication Nos. 2004/0178156; 2006/0113263; 2006/0283819; 2008/0016740; and German Patent No. DE19609432. The complete disclosures of the above patents and patent applications are herein incorporated by reference for all purposes.

SUMMARY OF THE DISCLOSURE

Some embodiments provide a shelving system for displaying items. In some embodiments, the shelving system may include a frame base; upright frame bars connected to the frame base, the upright frame bars including a plurality of apertures; and a plurality of shelves. One or more shelves of the plurality of shelves may include front, left, right, and rear walls, the left and right walls including at least one connector configured to be received in one or more apertures of the plurality of apertures such that the shelf is installed in an inclined position; at least one base member connecting the front and rear walls; and at least one glide sheet configured to allow gravity to move the items supported on the at least one glide sheet toward the front wall when the shelf is in the inclined position. At least one base member and the front wall may be configured to support the at least one glide sheet, the rear wall may include a slot configured to receive the at least one glide sheet, and the shelf may be free from a locking mechanism that secures the at least one glide sheet to one or more other components of the shelf.

In some embodiments, the shelving system may include a frame base including a plurality of wheels; upright frame bars connected to the frame base, the upright frame bars including a plurality of apertures; and a plurality of shelves. One or more shelves of the plurality of shelves may include front, left, right, and rear walls, the left and right walls including at least one connector configured to be received in one or more apertures of the plurality of apertures such that the shelf is installed in an inclined position; base members connecting the front and rear walls; and glide sheets configured to allow gravity to move the items supported on the glide sheets toward the front wall when the shelf is in the inclined position. The glide sheets may include a front portion having at least one drain hole, a rear portion having a handle, and a plurality of grooves that extend from adjacent the rear portion to the front portion. The base members and the front wall may be configured to support the glide sheets, the rear wall may include a slot configured to receive the glide sheets, and the shelf may be without a locking mechanism that secures the glide sheets to one or more other components of the shelf.

Some embodiments provide a shelf for a shelving system for displaying items. In some embodiments, the shelf may include front, left, right, and rear walls, at least one of the left and right walls being configured to be attached to one or more other components of the shelving system such that the shelf is installed in an inclined position; at least one base member connecting the front and rear walls; and at least one glide sheet configured to allow gravity to move the items supported on the at least one glide sheet toward the front wall when the shelf is in the inclined position, wherein the at least one base member and the front wall is configured to support the at least one glide sheet, the rear wall including a slot configured to receive the at least one glide sheet, and the shelf being free from a locking mechanism that secures the at least one glide sheet to one or more other components of the shelf.

DETAILED DESCRIPTION OF THE DISCLOSURE

Figure 1:
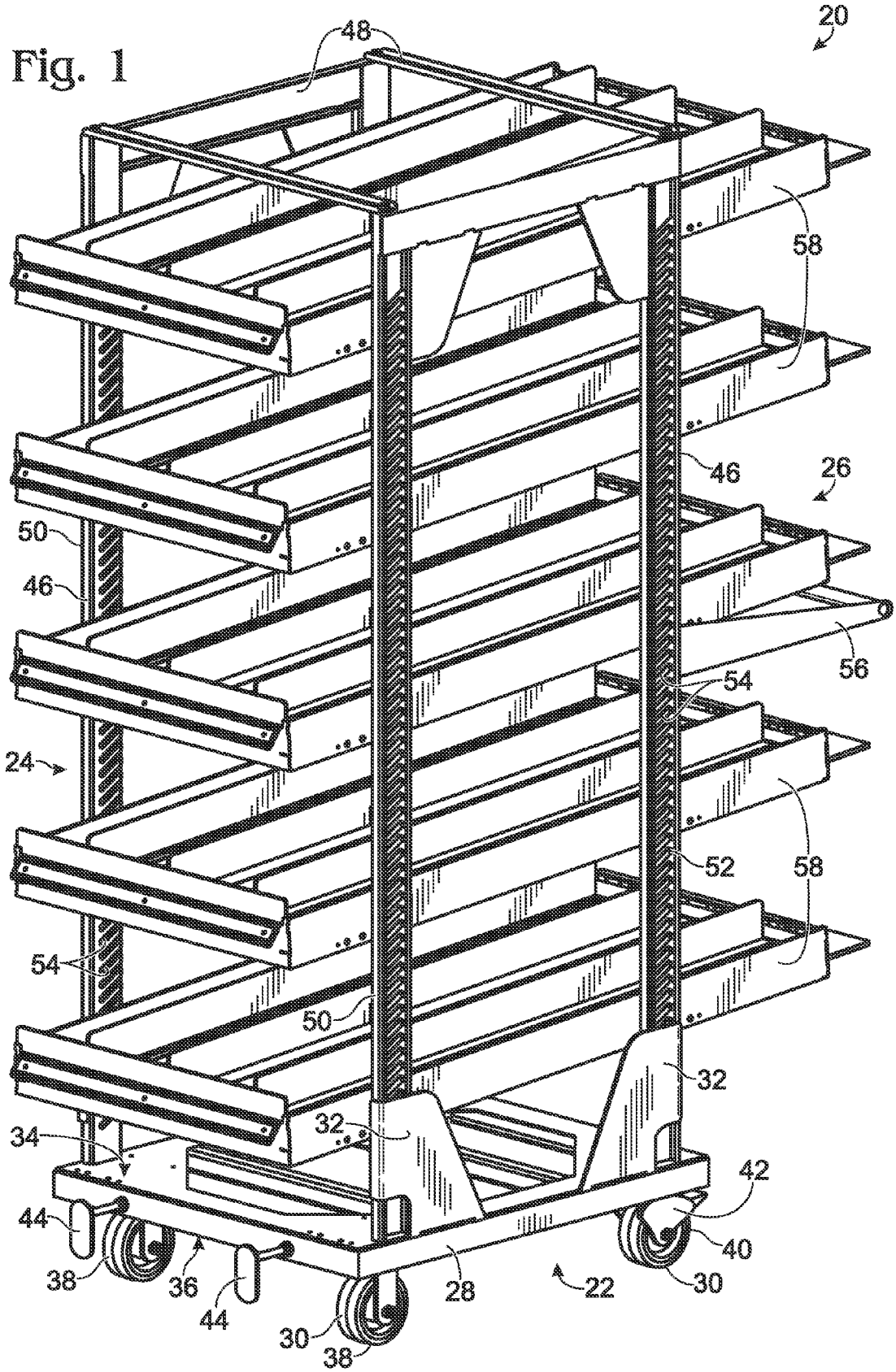
FIG. 1 is an isometric view of some embodiments of a shelving system.
Figure 2:
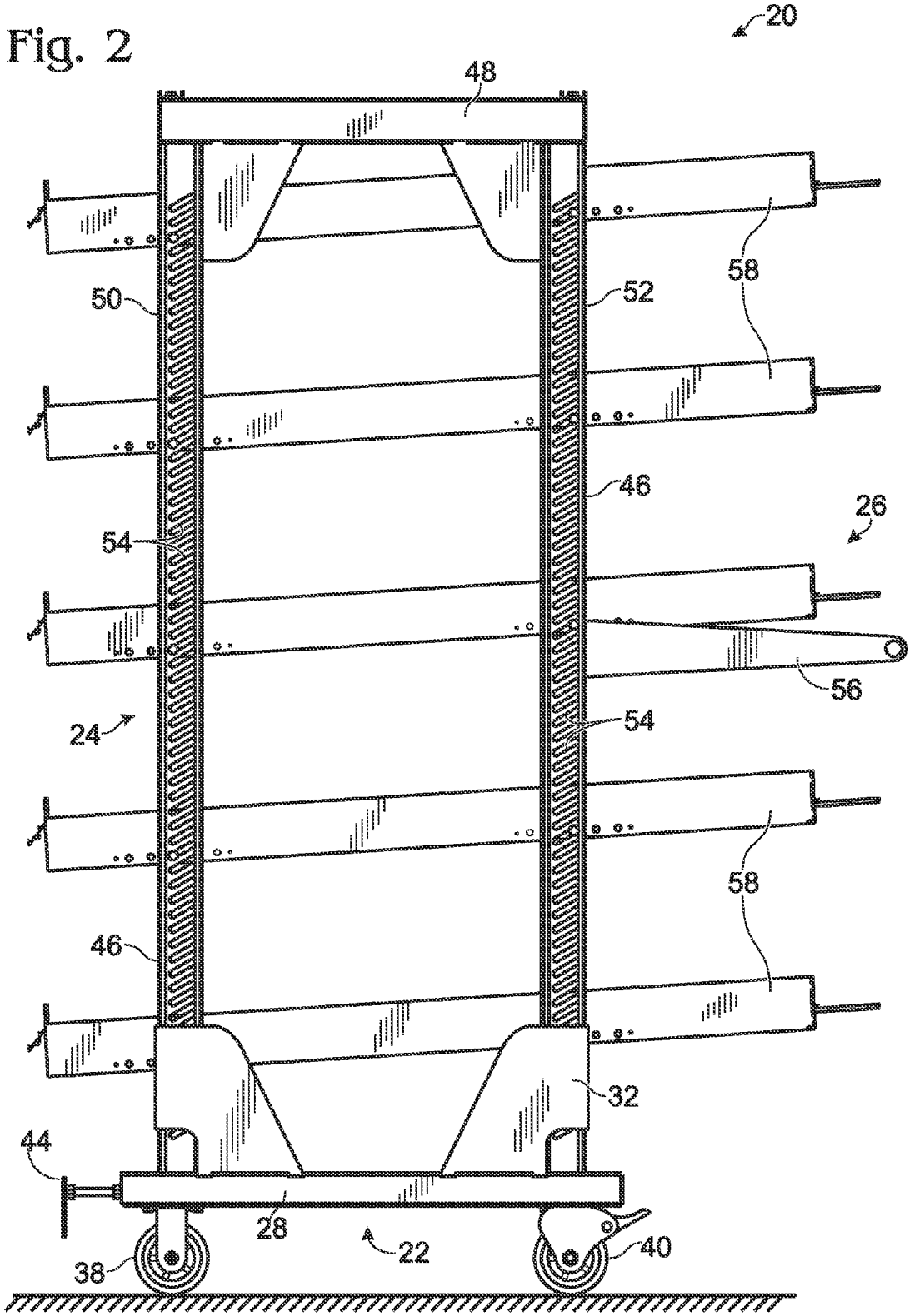
FIG. 2 is a side view of the shelving system of FIG. 1.

FIGS. 1-2 show some embodiments of a shelving system 20. The shelving system may be used for any suitable application(s). For example, the shelving system may be used inside one or more refrigerated display cases. Those display cases may include doors with glass panels to permit viewing of the items supported by the shelving system and to permit access to those items. The dimensions of shelving system 20 may be selected to fit those display cases and/or to support a desired number of items.

Shelving system 20 may include any suitable structure configured to support one or more items. For example, the shelving system may include a base assembly 22, a frame assembly 24, and a shelf assembly 26, as shown in FIGS. 1-2. The base assembly may include any suitable structure configured to be supported on a support surface and/or to support one or more other components of shelving system 20. For example, base assembly 22 may include a base (or frame base) 28, wheels 30, and frame bar connectors 32, as shown in FIGS. 1-2.

The base may include a top portion 34 and a bottom portion 36. Additionally, base 28 may be rectangular and/or any suitable shape(s), such as square, circular, triangular, etc. Wheels 30 may include front wheels 38 and rear wheels 40, as shown in FIGS. 1-2. The wheels may be movably connected to the bottom portion of the base and be configured to allow a user to move the shelving system across a support surface. One or more frame bar connectors 32 may be connected to top portion 34 of base 28 and may be configured to receive, support, and/or attach to frame bars of frame assembly 24 (further discussed below).

In some embodiments, base 28 may include at least one wheel locking mechanism 42, as shown in FIGS. 1-2. The wheel locking mechanism may include any suitable structure configured to allow a user to selectively lock one or more of wheels 30. The locking mechanism may be attached to one or more of the wheels, such as the front wheel(s), the rear wheel (s), and/or any suitable combination of wheels.

In some embodiments, base 28 may include at least one bumper 44, which may include any suitable structure configured to protect base 28 from physical contact and/or damage. The bumper also may allow a user to properly position the base within a desired space, such as an interior of a refrigerated display case. Base assembly 22 may additionally, or alternatively, include any suitable structure, such as drip pan (s) and/or other components. Although base 28 is shown to include four wheels 30, the base may include more or less wheels 30. Additionally, although base assembly 22 is shown to include base 28, wheels 30, and frame bar connectors 32, the base assembly may include any suitable mechanism(s) to allow a user to move the shelving system, such as sliding and/or pivoting mechanism(s).

Frame assembly 24 may include any suitable structure configured to support shelf assembly 26. For example, frame assembly 24 may include frame bars (or upright frame bars) 46 and cross bars 48. The frame bars may include front frame bars 50 and rear frame bars 52, as shown in FIGS. 1-2. Those frame bars may be connected or mounted to the base via, for example, frame bar connector(s) 32. The frame bars may be any suitable lengths to support any desired number of shelves of shelf assembly 26. For example, frame bars 46 may be sized to support five shelves of shelf assembly 26, as shown in FIGS. 1-2. Alternatively, the frame bars may be sized to support one, two, three, four, six, seven, eight, nine or more shelves of shelf assembly 26.

Any suitable number of front frame bars 50 and rear frame bars 52 may be connected to the base. For example, two front and two rear upright frame bars may be connected to the base, as shown in FIGS. 1-2. One or more of frame bars 46 may include a plurality of apertures 54 and/or other suitable structures configured to interact with one or more shelves of shelf assembly 26. The apertures may allow a user to manually adjust an incline of the shelves and/or to lock the shelves at a particular incline. Frame bars 46 may include apertures 54 along any suitable length of those frame bars.

In some embodiments, the frame bars may be adjustable and/or removable to allow a user to install more or less shelves on the frame assembly. For example, longer frame bars may be installed to support more shelves. Alternatively, shorter frame bars may be installed to support less shelves or to fit within a desired space. Cross bars 48 may connect two or more of the upright frame bars. For example, the cross bars may connect frame bars 46 to each other, as shown in FIGS. 1-2. Although frame assembly 24 is shown to include cross bars 48 only on the top portion of the frame bars, the frame assembly may additionally, or alternatively, include cross bars on one or more other portions of the frame bars, such as a central portion of the frame bars.

In some embodiments, frame assembly 24 may include a frame handle 56 (as shown in FIG. 1), which may include any suitable structure configured to allow a user to move the shelving system. Although frame assembly 24 is shown to include frame bars 46 and cross bars 48, the frame assembly may additionally, or alternatively, include any suitable structure configured to support the shelf assembly.

Figure 3:
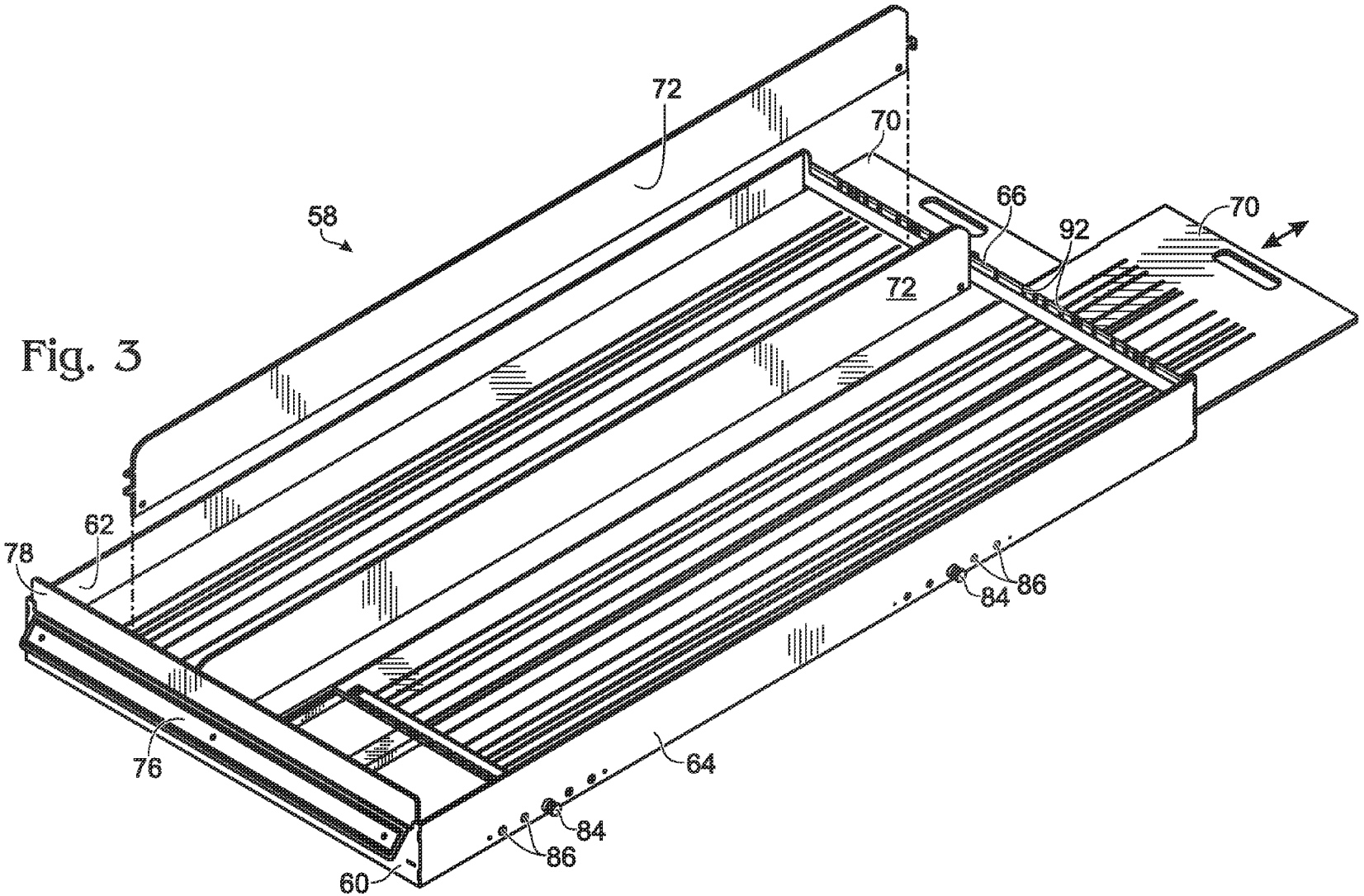
FIG. 3 is an isometric view of a shelf of the shelving system of FIG. 1.
Figure 4:
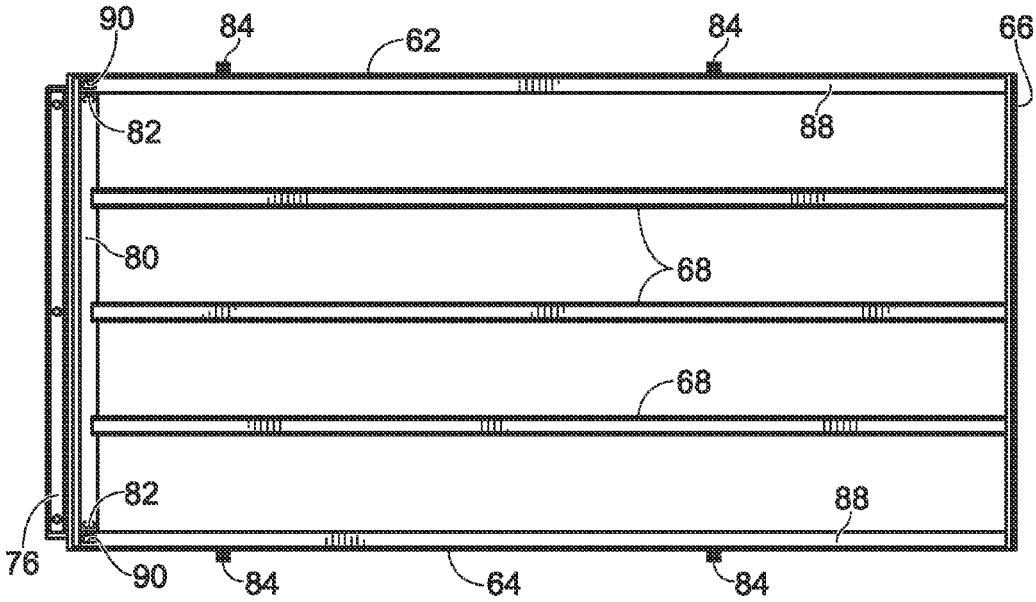
FIG. 4 is a top view of the shelf of FIG. 3 shown without glide sheets and vertical dividers.

Shelf assembly 26 may include any suitable structure configured to support one or more items. For example, shelf assembly may include a plurality of shelves 58, as shown in FIGS. 1-2. One or more shelves of the plurality of shelves may include a front wall 60, a first sidewall (or left wall) 62, a second sidewall (or right wall) 64, a rear wall 66, at least one base member 68, at least one glide sheet 70, and at least one divider 72, as shown in FIGS. 3-4. The front, rear, left, and right walls may be connected to form a rectangular shelf. Although the shelf base is shown to be rectangular, the shelf base may be any suitable shape, such as circular, triangular, etc.

Figure 8:
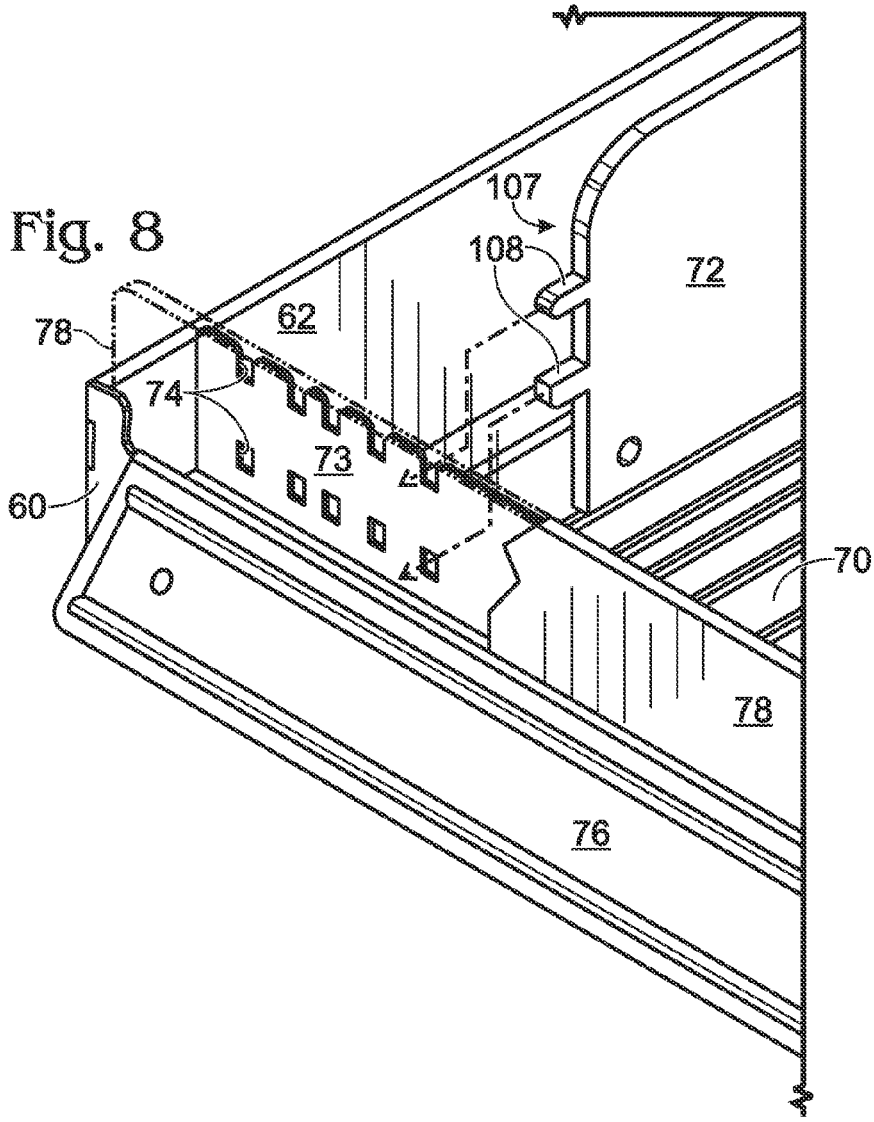

Base member 68 may connect the front and rear walls. When shelf 58 is installed in an inclined position (as further discussed below), the front wall and one or more of the base members may be configured to support glide sheet 70. The front wall may include an orifice panel 73 with a plurality of front orifices 74 configured to receive an end portion of the divider, as shown in FIG. 8 and further discussed below. Although front orifices 74 are shown to be formed on orifice panel 73, the front orifices may alternatively, or additionally, be formed on other parts of the front wall. In some embodiments, front wall 60 may include a label holder 76, a stop end 78, and/or a front drain channel 80, as shown in FIGS. 3-4. The drain channel may include a front channel hole 82 to allow liquid trapped in the drain channel to be removed.

The left and/or right walls may include at least one connector 84 configured to be received in one or more apertures 54 such that, for example, the shelf is installed in an inclined position. Connector 84 may include any suitable structure and may be attached to the left and/or right walls in any suitable way(s). For example, connector 84 may include a bolt attached to the left and/or right walls with a hex nut. In some embodiments, the left and/or right walls may include a plurality of openings 86 configured to receive connector 84. Apertures 54 and openings 86 may allow a user to attach shelves 58 to frame assembly 24 in any suitable positions. For example, a user may vary which opening 86 receives connector 84 and/or which aperture 54 receives that connector based on a desired position on the shelf.

Although shelves 58 are shown to be attached to the frame assembly in a particular inclined position, the shelves may additionally, or alternatively, be configured to be attached to the frame assembly in any suitable positions. For example, one or more of the shelves may be attached in a horizontal (non-inclined) position. Alternatively, or additionally, one or more shelves 58 may be attached in more and/or less inclined positions as compared to the shelves shown in FIGS. 1-2. In some embodiments, the left and/or right walls may include side drain channels 88 that may include at least one side channel hole 90.

Rear wall 66 may include a plurality of rear orifices 92 and at least one slot 94. The rear orifices may be configured to receive an end portion of divider 72. Slot 94 may be configured to receive one or more glide sheets 70. Although slot 94 is configured to receive two glide sheets 70, the slot may be configured to receive one, three, four, or more glide sheets. Additionally, although shelf 58 is shown to include a single slot 94, the shelf may include two or more slots 94. For example, the shelf may include two slots with each slot configured to receive one or more glide sheets 70.

Figure 5:
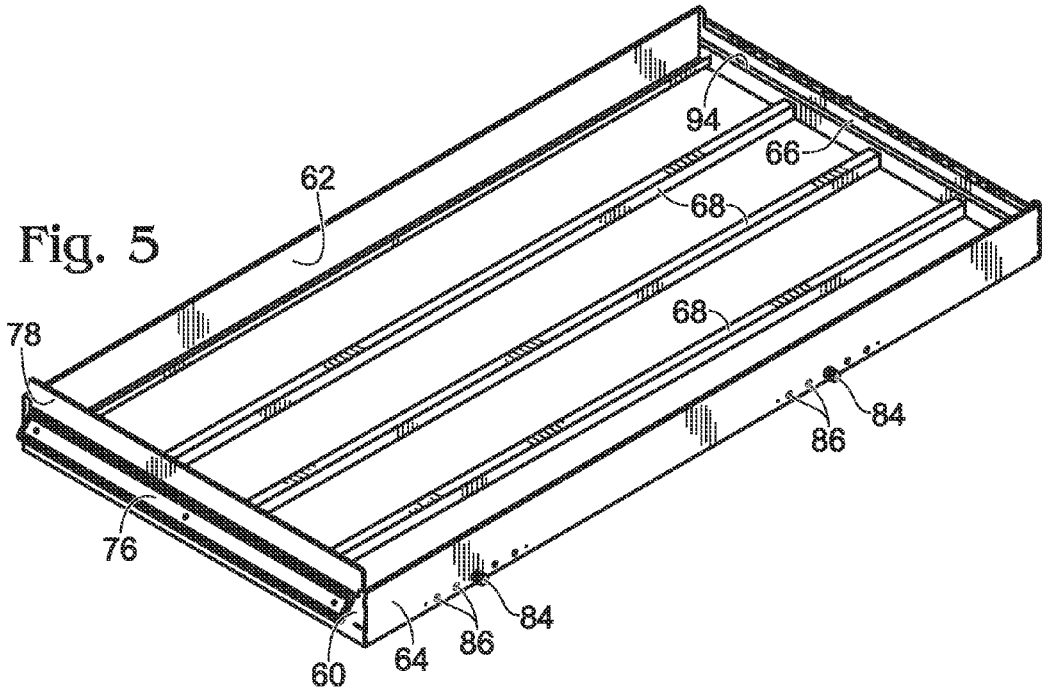
FIG. 5 is an isometric view of the shelf of FIG. 4.

Shelf 58 may include any suitable number of base members 68. For example, the shelf may include three base members 68, as shown in FIGS. 4-5. Alternatively, one or more shelves 58 may include one, two, four, five, or more base members. Additionally, the base members may be any suitable width(s). Although base members 68 are shown to have widths less than the width of a glide sheet, one or more of the base members may include widths equal to or greater than the width of a glide sheet. For example, one or more shelves 58 may include a single base member with a width that spans between the left and right walls.

Figure 6:
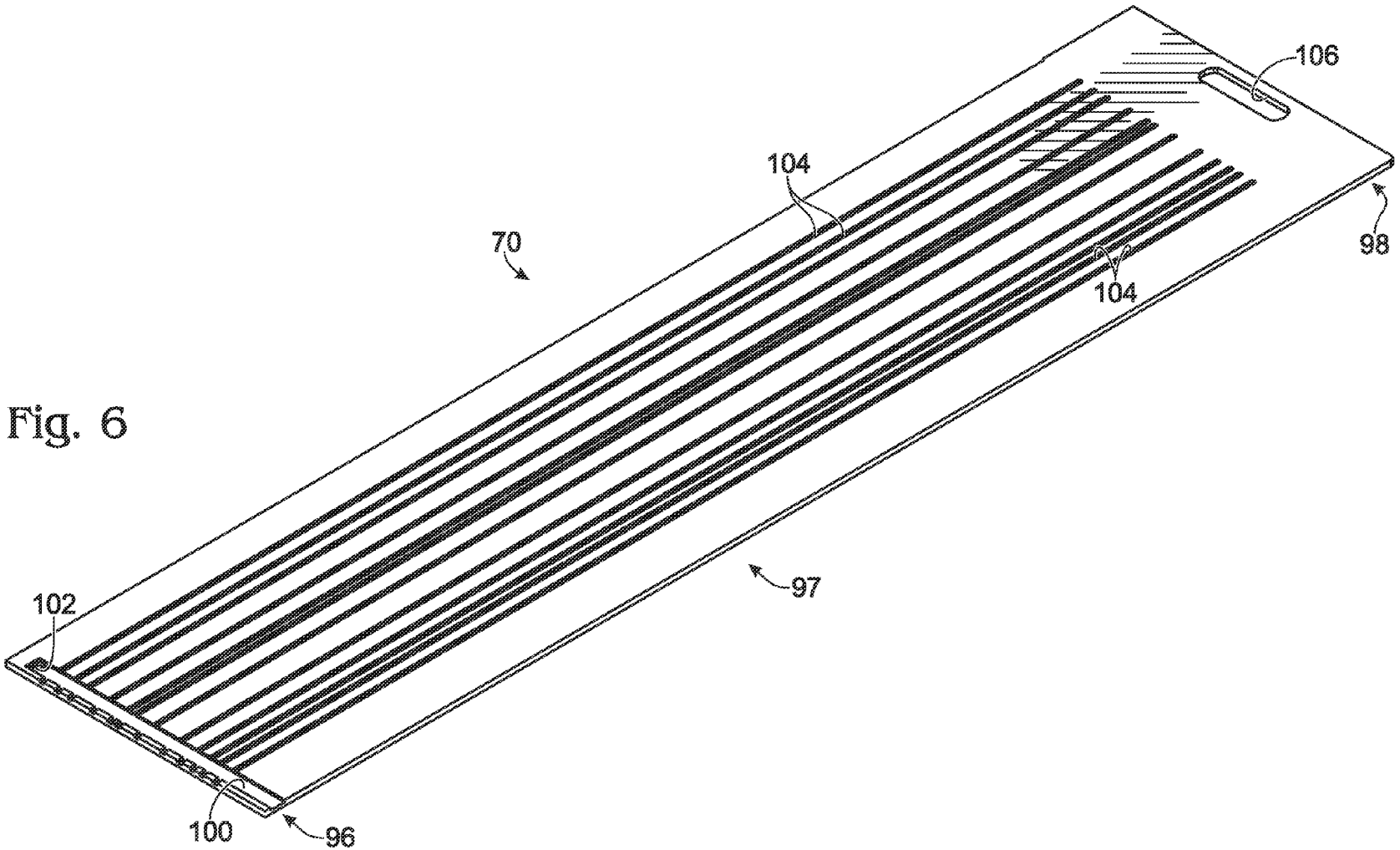
FIG. 6 is an isometric view of a glide sheet of the shelf of FIG. 3.

Glide sheet 70 may include any suitable structure configured to allow gravity to move items supported on the glide sheet toward the front wall, such as when the shelf is inclined. The glide sheet may include a front portion 96, a middle portion 97, and a rear portion 98, as shown in FIG. 6. The front portion of glide sheet 70 may be adjacent to front wall 60, such as when the glide sheet is supported on one or more base members 68 and/or the front wall. Front portion 96 may include at least one front drain channel 100. In some embodiments, front drain channel 100 may include a front drain hole 102, as shown in FIG. 6.

Middle portion 97 may be disposed between front portion 96 and rear portion 98. The middle portion may include a plurality of grooves 104, as shown in FIG. 6. The grooves may be configured to decrease the coefficient of friction between the glide sheet and the items supported on the glide sheet, and/or provide channels for liquids to drain toward front portion 96. The plurality of grooves may extend along any suitable portion(s) of the glide sheet. For example, grooves 104 may extend from the rear portion (or adjacent the rear portion) of the glide sheet toward or to the front portion of that glide sheet, and/or at least part of the front portion. Although the glide sheet is shown to include grooves 104, the glide sheet may alternatively, or additionally, include ribs, protuberances, bumps, valleys, channels, and/or other structure configured to decrease the coefficient of friction between the glide sheet and the items supported on the glide sheet, and/or provide channels for liquids to drain toward front portion 96.

Rear portion 98 may extend beyond rear wall 66, such as when the glide sheet is supported on one or more base members 68 and/or the front wall. In some embodiments, that rear portion may include at least one handle 106. The handle may be in the form of one or more apertures in rear portion 98. Handle 106 may alternatively, or additionally, include any suitable structure.

The glide sheet may be made of any suitable material(s). For example, the glide sheet may be made of high density polyethylene (HDPE) and/or other polyethylene (PE) materials. An example of HDPE suitable for use as a glide sheet includes SANATEC® cutting boards manufactured by Scranton Products. Alternatively, or additionally, silicon may be added to the HDPE to increase the glide sheets' ability to advance the items to the front of the shelf. Although the transport assembly is shown to include the glide sheet, the transport assembly may alternatively, or additionally, include other structure configured to allow gravity to advance items to the front of the shelf. For example, the transport assembly may include a plurality of rollers and/or other structure(s).

When installed, glide sheet(s) 70 may be supported by one or more base members 68 and/or front wall 60. The shelf assembly may be free from (or without) a locking mechanism that secures the glide sheets to one or more other components of the shelf. In other words, only gravity may keep glide sheet(s) supported on the base member(s) and/or front wall. A user may then simply remove the glide sheet(s) by pulling on handle(s) 106 and sliding the glide sheet(s) out of the shelf through slot 94.

Figure 7:
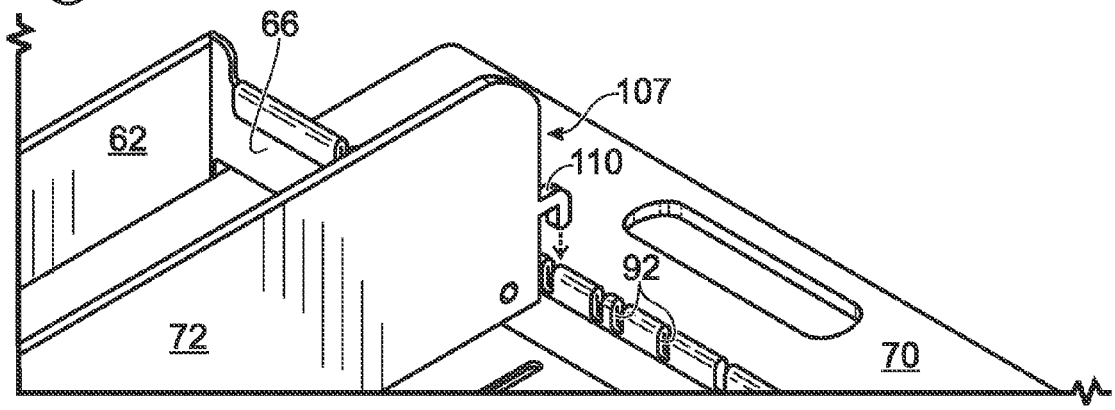
FIGS. 7-8 are partial views of the shelf of FIG. 3 showing installation of a divider.

Divider(s) 72 may include end portions 107 configured to be received in front orifices 74 and/or rear orifices 92. For example, divider(s) 72 may include at least one front tab 108 and at least one rear tab 110. The front tab(s) may be configured to be received in one or more of front orifices 74, while the rear tab(s) may be configured to be received in one or more rear orifices 92, as shown in FIGS. 7-8. A user may install one or more dividers 72 to accommodate any suitable size(s) of items supported on the shelf.

Although dividers 72 are shown to include tabs with particular shapes, those tabs may alternatively, or additionally, be any suitable shape(s) configured to be received in the orifices of the front and rear walls. Additionally, although dividers 72 are shown to include tabs and the front and rear walls are shown to include orifices, the divider(s) may alternatively, or additionally, include orifices and/or other suitable structure, and the front and rear walls may include tabs and/or other suitable structure.

Figure 10:
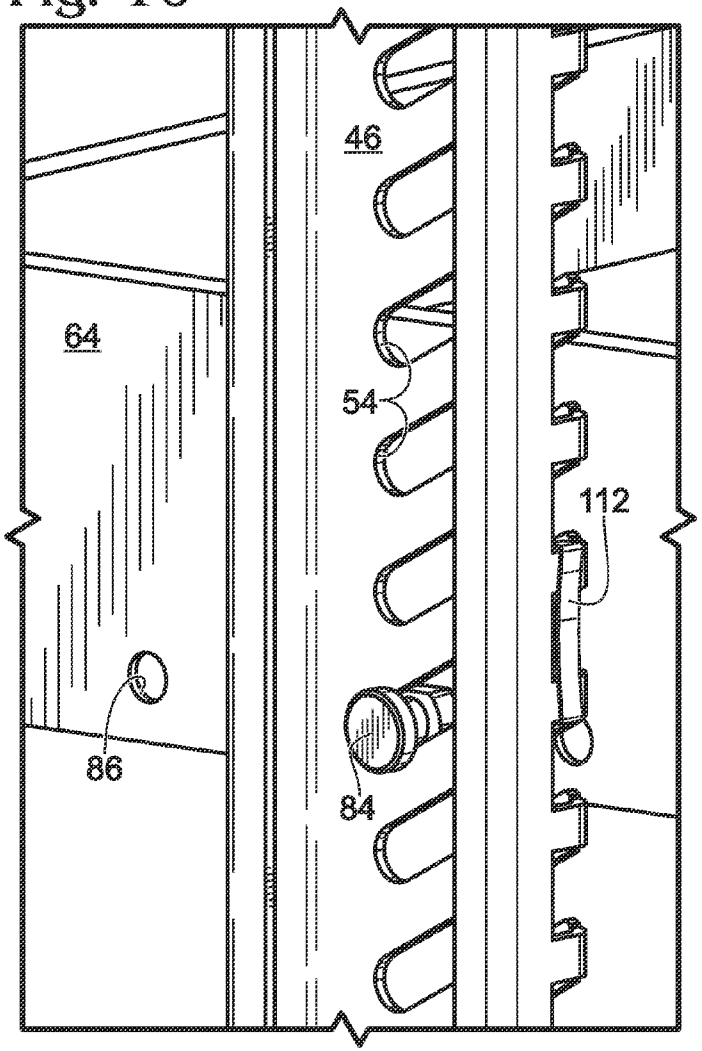
FIGS. 9-10 are partial views of the shelving system of FIG. 1 showing insertion of a connector of the shelf of FIG. 3 to a frame assembly of the shelving system.
Figure 9:
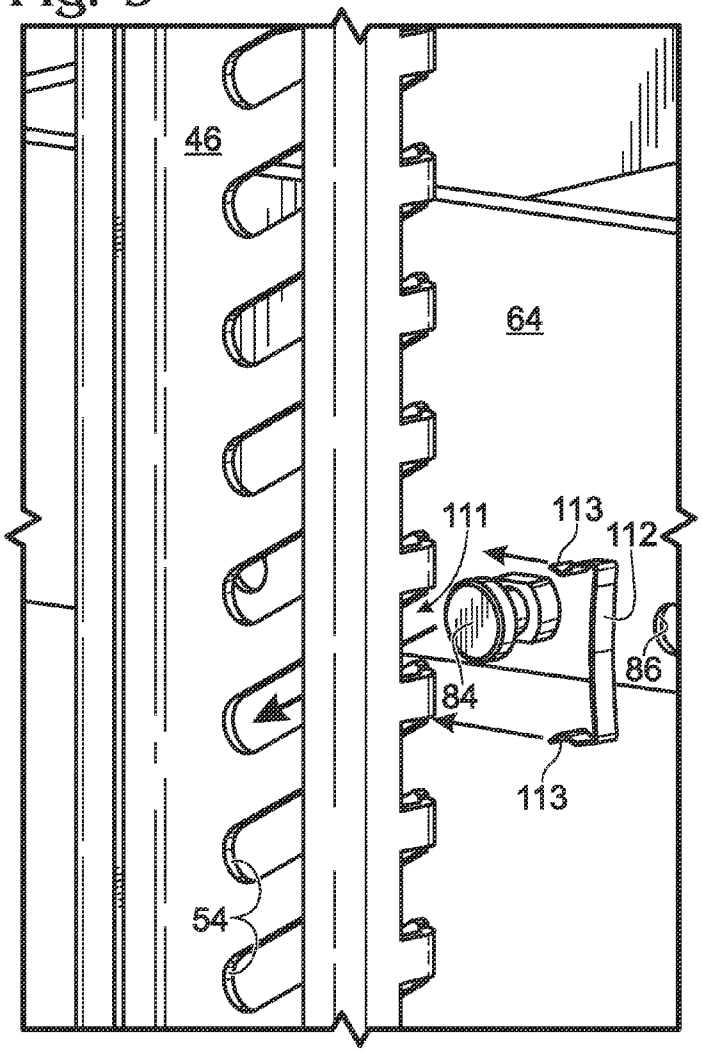

Shelves 58 may be installed or mounted to the frame assembly by inserting connector 84 into a curved portion 111 of the desired aperture 54 and then sliding the connector within the aperture away from the curved portion, such as shown in FIGS. 9-10. In some embodiments, shelving system 20 may include at least one locking clip 112 configured to block curved portion 111 to secure connector 84 within aperture 54 and/or prevent accidental removal of connector 84 from aperture 54. The locking clip may include end portions 113 that may be received in adjacent apertures 54, as shown in FIGS. 9-10. Although shelving system 20 is shown to include locking clip 112, the shelving system may alternatively, or additionally, include any suitable structure configured to secure and/or lock connector(s) 84 to aperture(s) 54.

Figure 11:
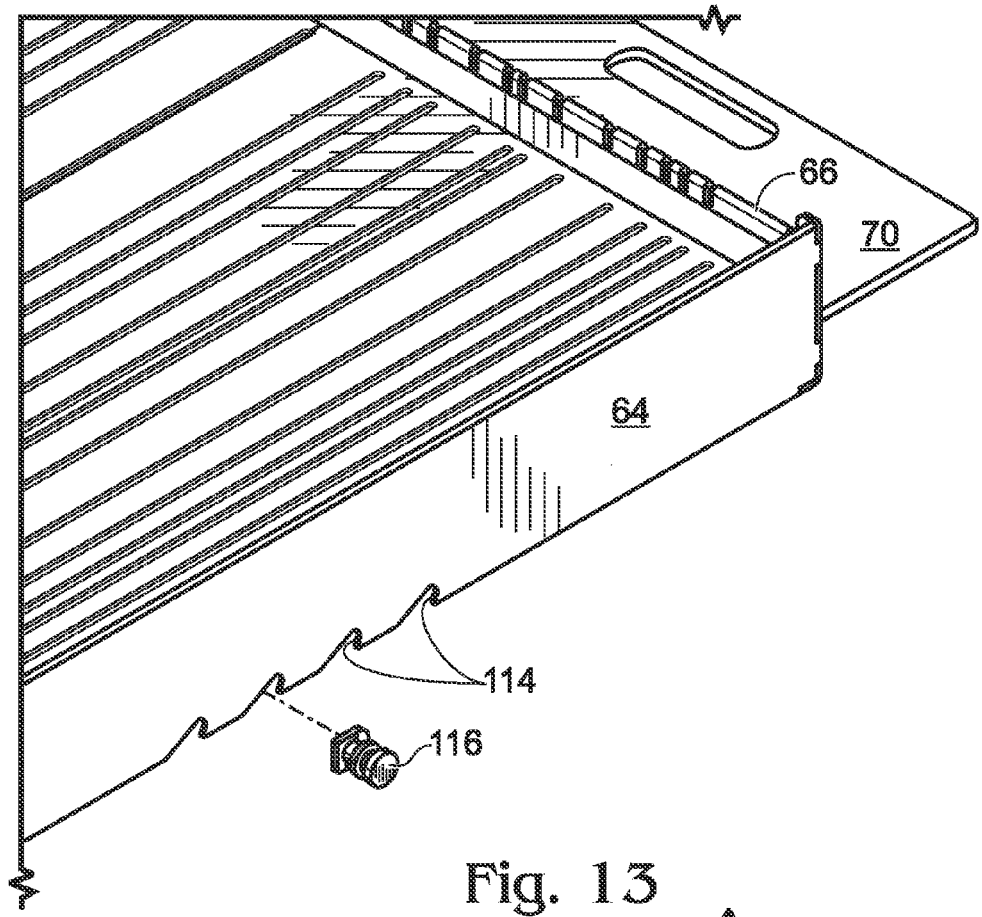
FIG. 11 is a partial view of an alternative embodiment of the shelf of FIG. 3.

Additionally, although shelf assembly 26 is shown to include particular connectors 84 and openings 86, the shelf assembly (such as the left and/or right walls) may include any suitable structure configured to be attached to one or more other components of the shelving system such that the shelf is installed, for example, in an inclined position. For example, left wall 62 and/or right wall 64 may alternatively, or additionally, include openings 114, as shown in FIG. 11.

Figure 12:
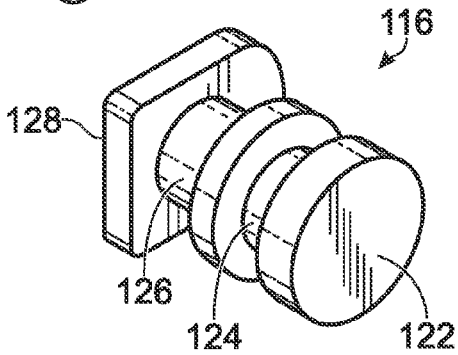
FIG. 12 is a partial view of an alternative embodiment of the connector of the shelf of FIG. 11.
Figure 13:
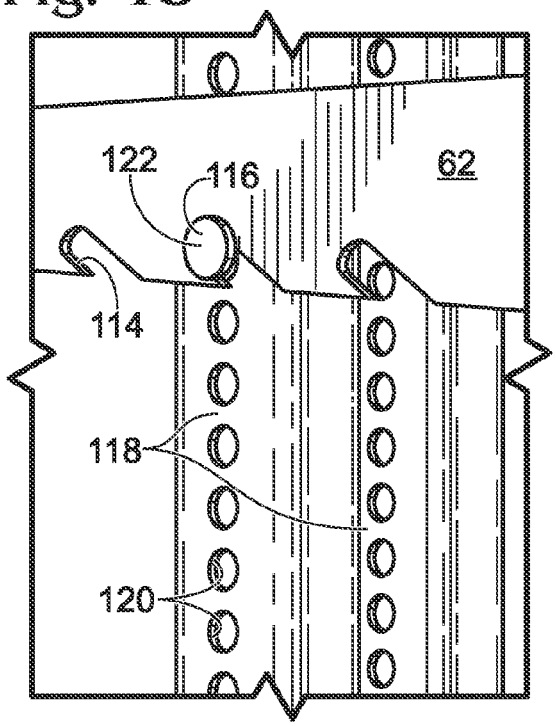
FIG. 13 is a partial view of the shelf of FIG. 11 showing a sidewall of the shelf installed on an alternative embodiment of the frame assembly of the shelving system of FIG. 1.

Openings 114 may be configured to receive connector(s) 84 and/or other suitable connectors, such as at least one connector 116, as shown in FIG. 12. Shelves 58 with openings 114 and/or connector(s) 116 may be installed on the frame assembly discussed above and/or other frame assemblies, such as frame assembly 118 with apertures 120 in FIG. 13. Connector 116 may include a head portion 122, a shelf slot 124, a frame slot 126, and a tail portion 128. Alternatively, or additionally, left and/or right walls may be free or without openings 114 and may be supported on or within shelf slot 124.

Other types of shelving systems may be retrofitted according to at least some of the teachings of the present disclosure. For example, a retrofit kit having one or more glide sheets 70 and dividers 72 may be installed into other shelves. In some embodiments, the retrofit kit may include one or more shelves 58. The shelves may include suitable connectors, such as connectors 84, connectors 116, and/or other connectors, and/or suitable openings, such as openings 86, openings 114, and/or other openings.

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A shelving system for displaying items, comprising:

a frame base;

upright frame bars connected to the frame base, the upright frame bars including a plurality of apertures; and a plurality of shelves, one or more shelves of the plurality of shelves including:

front, left, right, and rear walls, the left and right walls including at least one connector configured to be received in one or more apertures of the plurality of apertures such that the shelf is installed in an inclined position, at least one base member connecting the front and rear wall, and at least one glide sheet configured to allow gravity to move the items supported on the at least one glide sheet toward the front wall when the shelf is in the inclined position, wherein the at least one base member and the front wall are configured to support the at least one glide sheet, the rear wall including a slot configured to receive the at least one glide sheet, and the shelf being free from a locking mechanism that secures the at least one glide sheet to one or more other components of the shelf, wherein the at least one glide sheet is a flat planar sheet without front, side, and rear walls attached to, or formed with, the flat planar sheet, wherein a top end portion of the rear wall and a top end portion of the front wall include a plurality of orifices configured to receive a plurality of dividers having end portions configured to be received in the plurality of orifices, wherein the rear wall defines a plane and the slot and the plurality of orifices of the rear wall are within the plane.

2. The shelving system of claim 1, wherein the at least one glide sheet includes a rear portion that extends beyond the rear wall when the at least one glide sheet is supported on the at least one base member and the front wall, the rear portion including at least one handle.

3. The shelving system of claim 2, wherein the at least one glide sheet includes a front portion that is adjacent to the front wall when the at least one glide sheet is supported on the at least one base member and the front wall, the front portion including at least one drain hole.

4. The shelving system of claim 3, wherein the at least one glide sheet includes a plurality of grooves that extend from adjacent the rear portion of the at least one glide sheet to the front portion.

5. The shelving system of claim 1, wherein the left and right walls include a plurality of openings configured to receive the at least one connector.

6. The shelving system of claim 1, wherein the at least one glide sheet is made of high density polyethylene.

7. The shelving system of claim 1, wherein the frame base includes a plurality of wheels.

8. A shelf for a shelving system for displaying items, comprising:

front, left, right, and rear walls, at least one of the left and right walls being configured to be attached to one or more other components of the shelving system such that the shelf is installed in an inclined position;

at least one base member connecting the front and rear walls; and at least one glide sheet configured to allow gravity to move the items supported on the at least one glide sheet toward the front wall when the shelf is in the inclined position, wherein the at least one base member and the front wall is configured to support the at least one glide sheet, the rear wall including a slot configured to receive the at least one glide sheet, and the shelf being free from a locking mechanism that secures the at least one glide sheet to one or more other components of the shelf, wherein the at least one glide sheet is a flat planar sheet without front, side, and rear walls attached to, or formed with, the flat planar sheet, wherein a top end portion of the rear wall and a top end portion of the front wall include a plurality of orifices configured to receive a plurality of dividers having end portions configured to be received in the plurality of orifices, wherein the rear wall defines a plane and the slot and the plurality of orifices of the rear wall are within the plane.

9. The shelf of claim 8, wherein the at least one glide sheet includes a rear portion that extends beyond the rear wall when the at least one glide sheet is supported on the at least one base member, the rear portion including at least one handle.

10. The shelf of claim 9, wherein the at least one glide sheet includes a front portion that is adjacent to the front wall when the at least one glide sheet is supported on the at least one base member, the front portion including at least one drain hole.

11. The shelf of claim 10, wherein the at least one glide sheet includes a plurality of channels that extend from adjacent the rear portion of the at least one glide sheet to the front portion.

12. The shelf of claim 8, wherein at least one of the left and right walls includes at least one connector.

13. The shelf of claim 12, where the shelving system includes a frame base and upright frame bars connected to the frame base, the upright frame bars including a plurality of apertures, wherein the at least one connector is configured to be received in one or more apertures of the plurality of apertures.

14. The shelf of claim 8, wherein the at least one glide sheet is made of high density polyethylene.

15. A shelving system for displaying items, comprising:

a frame base including a plurality of wheels;

upright frame bars connected to the frame base, the upright frame bars including a plurality of apertures; and a plurality of shelves, one or more shelves of the plurality of shelves including:

front, left, right, and rear walls, the left and right walls including at least one connector configured to be received in one or more apertures of the plurality of apertures such that the shelf is installed in an inclined position, at least first and second base members connecting the front and rear walls, the first and second base members being elongate and sized to provide at least one gap between the left wall and the first base member, between the first and second base members, and between the second base member and the right wall, and glide sheets configured to allow gravity to move the items supported on the glide sheets toward the front wall when the shelf is in the inclined position, wherein the glide sheets include a front portion having at least one drain hole, a rear portion having an aperture sized to be grasped by a user, and a plurality of grooves that extend from adjacent the rear portion to the front portion, the at least one glide sheet being a flat planar sheet without front, side, and rear walls attached to, or formed with, the flat planar sheet, wherein the base members and the front wall are configured to support the glide sheets, wherein the rear wall includes a bottom end portion, a top end portion, and an intermediate portion disposed between the bottom end portion and the top end portion, the at least first and second base members being attached to the bottom end portion, the intermediate portion including a single slot extending across at least a substantial portion of the width of the rear wall and configured to receive the glide sheets, wherein the top end portion of the rear wall and a top end portion of the front wall include a plurality of orifices configured to receive a plurality of dividers having end portions configured to be received in the plurality of orifices, wherein the rear wall defines a plane and the slot and the plurality of orifices are within the plane, and wherein the shelf is without a locking mechanism that secures the glide sheets to one or more other components of the shelf.

16. The shelving system of claim 15, wherein the left and right walls include a plurality of openings configured to receive the at least one connector.

17. The shelving system of claim 15, wherein the at least one glide sheet is made of high density polyethylene.

18. The shelving system of claim 15, wherein one or more shelves of the plurality of shelves further includes the plurality of dividers having end portions configured to be received in the plurality of orifices.

19. The shelving system of claim 1, further comprising the plurality of dividers having the end portions configured to be received in the plurality of orifices.

20. The shelf of claim 8, further comprising the plurality of dividers having the end portions configured to be received in the plurality of orifices.

* * * * *